United States Patent [19]

Ihle

[11] 4,107,970

[45] Aug. 22, 1978

[54] MACHINE FOR FLATTENING STRIP METAL

[75] Inventor: Josef Ihle, Pforzheim, Fed. Rep. of Germany

[73] Assignee: Irma Ungerer geb. Dollinger, Pforzheim, Fed. Rep. of Germany

[21] Appl. No.: 793,941

[22] Filed: May 5, 1977

[30] Foreign Application Priority Data

Oct. 13, 1976 [DE] Fed. Rep. of Germany ..... 2646201

[51] Int. Cl.[2] ..... B21D 1/02

[52] U.S. Cl. ..... 72/165

[58] Field of Search ..... 72/165, 163, 160

[56] References Cited

U.S. PATENT DOCUMENTS

| | | | |
|---|---|---|---|
| 2,796,908 | 6/1957 | Shields | 72/165 X |
| 3,477,266 | 11/1969 | Fornataro | 72/165 |

FOREIGN PATENT DOCUMENTS

| | | | |
|---|---|---|---|
| 715,813 | 1/1942 | Fed. Rep. of Germany | 72/163 |
| 708,255 | 7/1941 | Fed. Rep. of Germany | 72/163 |
| 660,873 | 11/1952 | United Kingdom | 72/163 |

*Primary Examiner*—Milton S. Mehr

[57] ABSTRACT

A stationary set of upper rolls are carried by a stationary frame. A yoke is mounted in said frame for adjustment in height. A set of lower rolls are mounted in said yoke adjacent to said upper rolls and adjustable in height relative thereto in unison with said yoke. Adjusting shaft means are rotatably mounted in said frame. Connecting rod means are eccentrically mounted on said adjusting shaft means and pivoted to said yoke and arranged to adjust said yoke in height in response to a rotation of said adjusting shaft means.

11 Claims, 4 Drawing Figures

MACHINE FOR FLATTENING STRIP METAL

Figure 1:
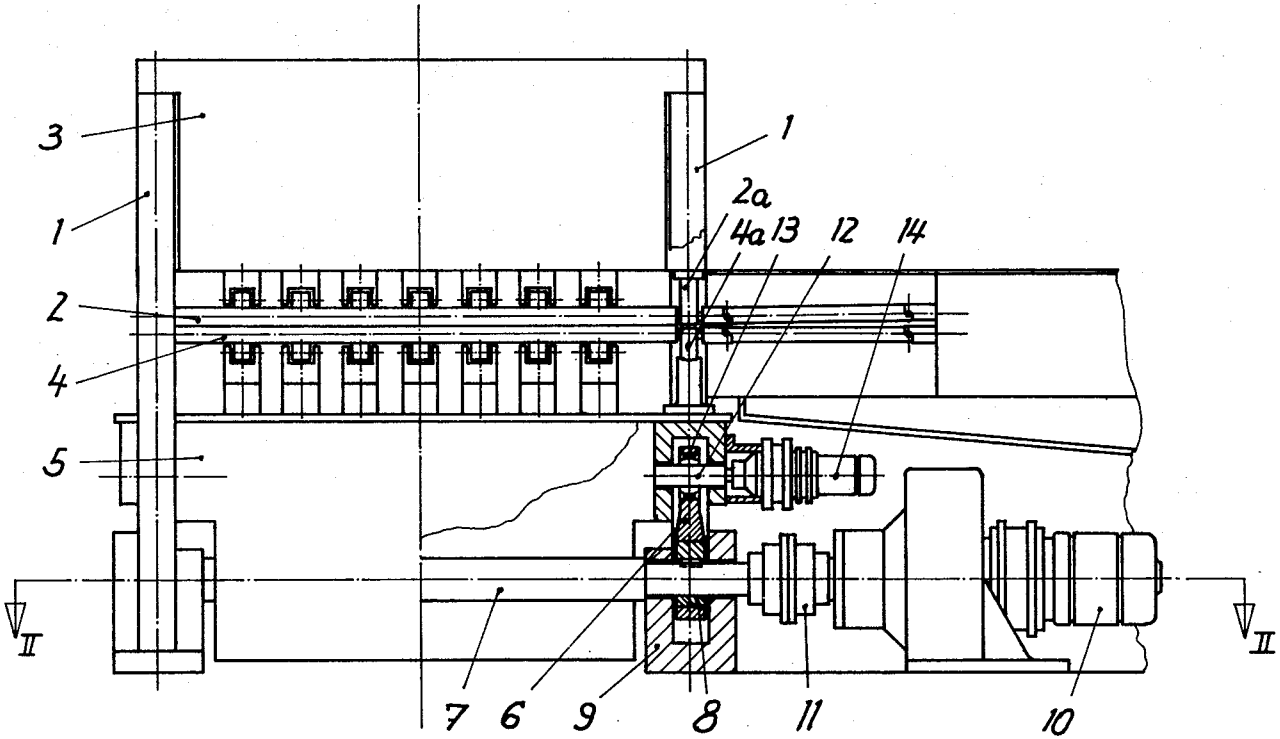

This invention relates to a machine for flattening sheet metal, particularly strip metal, comprising a stationary set of upper rolls and an adjustable set of lower rolls.

Flattening machines comprising an adjustable set of upper rolls are known, as well as flattening machines comprising an adjustable set of lower rolls. The former inherently involve a high expenditure. It is known to provide hydraulic supports for a yoke, which carries the lower rolls, in order to enable an adjustment thereof although strong flattening forces cannot be exerted with such arrangement. It is also known to support the lower rolls by a yoke which is formed with recesses, in which said yoke engages vertically and laterally adjustable guide members consisting of segments of a solid of revolution (U.S. Pat. No. 3,626,736).

A modification of the flattening machine disclosed in U.S. Pat. No. 3,626,736 is disclosed in U.S. Pat. No. 3,611,774 and comprises a saddle, which is mounted in the main frame of the machine for vertical adjustment, adjusting members, which carry the guide members on opposite sides of the frame and are mounted on the saddle for adjustment relative thereto in a vertical direction and generally in the direction of the axis on which the guide members are centered, and a wedge, which is interposed between said saddle and said frame and horizontally movable to adjust said saddle at high speed in a vertical direction.

In both arrangements, large forces are required for an adjustment to overcome the friction which is involved.

It is an object of the invention to provide simplified means for adjusting the lower set of rolls so that flattening machines can be provided which are less expensive than machines having adjustable upper rolls but have the same capacity and precision.

In a machine for flattening sheet metal, particularly strip metal, comprising a stationary set of upper rolls and an adjustable set of lower rolls, this object is accomplished in that the lower rolls are carried by a yoke and are adjustable in height by means of eccentrically mounted connecting rods, which are preferably carried by a common adjusting shaft. This arrangement consists of structurally simple parts and requires only small forces for an adjustment. Besides, backlash is eliminated as a result of the weight of the set of lower rolls, different from machines comprising adjustable upper rolls.

Specifically, the yoke which supports the lower rolls may consist of a channel member, which is disposed over a common adjusting shaft, which is mounted in the base frame of the machine, and the channel member may be carried by connecting rods, which are disposed at opposite ends of the channel member and are mounted on eccentric bushings, which are keyed to the adjusting shaft so that the connecting rods can be used to adjust the lower rolls in height. To enable an arrangement of the lower rolls with inclined longitudinal axes so that they engage the sheet metal only on one side, an additional adjusting mechanism may be provided between at least one connecting rod and the yoke. This additional adjusting mechanism may comprise a pin, which has an eccentric portion in the shape of a spherical segment that is mounted in the bearing used to support the yoke in the connecting rod. Besides, it is desirable to provide additional connecting rods, which are pivoted to the yoke on an axis which is offset from the axis on which the first-mentioned connecting rods are pivoted to the yoke so that the latter and the lower rolls can be tilted about the latter axis.

In accordance with a further feature of the invention, the adjusting shaft connected to the yoke and lower rolls by two eccentrically mounted connecting rods is rotatable by a motor and a torque-limitting coupling is connected between the adjusting shaft and its drive motor to prevent an overloading of the adjusting mechanism when joints between succeeding sheet metal elements travel through the nips between the upper and lower rolls.

Figure 2:
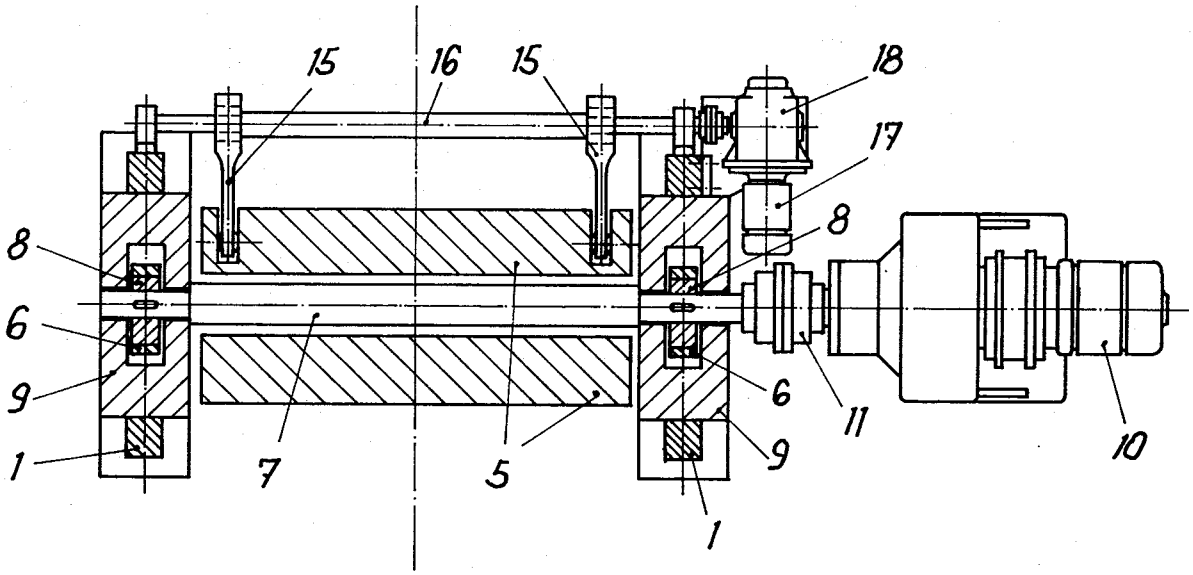
Figure 4:
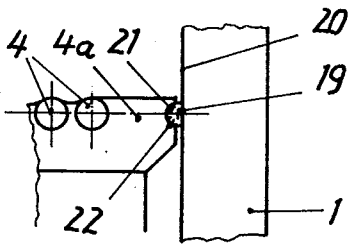
Figure 3:
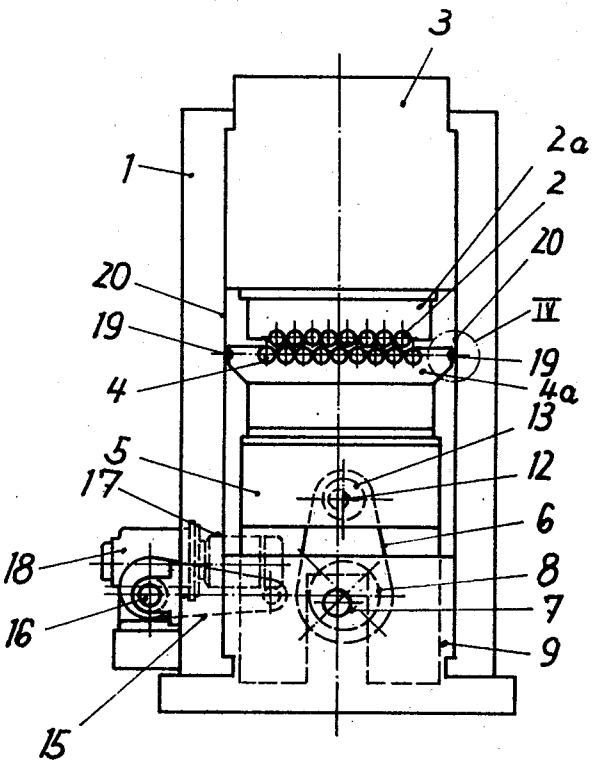

Further details of the flattening machine according to the invention will become apparent from the following description of illustrative embodiments shown on the accompanying drawings, in which FIG. 1 is a front elevation, partly in section, showing a flattening machine according to the invention as viewed from its entrance end, FIG. 2 is a horizontal sectional view taken from above on line II—II in FIG. 1, FIG. 3 is a side elevation showing the flattening machine of FIG. 1 and FIG. 4 is an enlarged view showing the portion designated IV in FIG. 3.

As is apparent from the drawing, a stationary set of upper rolls 2 as well as upper backing rollers are mounted in an upper mounted frame 2*a*, which is rigid with a stationary upper yoke 3, which is carried by an upright frame 1 of the machine. The set of lower rolls 4 as well as lower backing rollers are mounted in a mounting frame 4*a*, which is rigid with a channel-shaped lower yoke 5, which is adjustable in height and for this purpose is connected to a common adjusting shaft 7 by means of two connecting rods 6, which are pivoted to the yoke 5 and rotatably mounted on respective bushings 8, which are keyed to the shaft 7 and eccentric thereto. The latter is rotatably mounted in a base frame 9 of the machine and is rotatable by an adjusting motor 10 for adjusting the yoke 5. A torque-limiting coupling 11 is connected between the adjusting motor 10 and the adjusting shaft 7 to prevent an overloading of the mechanism, e.g., when joints between succeeding sheet metal elements travel through the nip between rolls 2 and 4.

As is also apparent from FIG. 1, the channel member 5 is connected to at least one connecting rod 6 by means of an additional eccentric adjusting mechanism, which comprises pin 12, which carries an eccentric spherical segment 13, which is mounted in a spherical bearing carried by the connecting rod 6. The eccentric pin 12 is adjustable by a motor 14 to impart an inclination to the longitudinal axes of the lower rolls 4 so that they engage the sheet metal only on one side, e.g., for flattening sheet metal which is wavy only on one side. To enable a tilting of the lower yoke about the axis on which the connecting rods 6 are pivoted thereto, connecting rods 15 are pivoted to the channel member 5 near respective ends thereof, as is apparent from FIG. 2, and are eccentrically mounted on a common adjusting shaft 16 for rotation thereon. The shaft 16 is connected to the adjusting motor 17 by bevel gearing 18 and operable to tilt the yoke 5 by means of the connecting rods 15. This tilting operation can be used to increase the nip between the rolls 2 and 4 at the entrance or exit end of the machine.

In accordacne with FIG. 3, the mounting frame 4*a* carries guide rollers 19, which have flattened portions, which slidably engage vertical guideways 20 provided on the upright frame 9 of the machine so as to guide the adjustable lower yoke and the lower rolls 4 during their adjustment in height and their tilting movement. Each flattened rollers 19 is provided with lubricating grooves, and retaining means are provided in the mounting frame 4*a* and engage each of said guide rollers 19 in said lubricating grooves at two diametrally opposite points.

What is claimed is:

1. A machine for flattening sheet metal, comprising
a stationary frame,
a stationary set of upper rolls carried by said frame,
a yoke mounted in said frame for adjustment in height,
a pin rotatably mounted in said yoke,
a set of lower rolls mounted in said yoke, adjacent to said upper rolls and adjustable in height relative thereto in unison with said yoke,
adjusting shaft means rotatably mounted in said frame,
a pair of connecting rods eccentrically mounted on said adjusting shaft means and pivoted to said yoke and arranged to adjust said yoke in height in response to a rotation of said adjusting shaft means,
a spherical bearing provided in one of said connecting rods,
a spherical segment which is non-rotatably connected to said pin, being eccentric thereto, and rotatably mounted in said bearing for pivoting said one of said connecting rods to said yoke, and
drive means carried by said yoke and power operable to rotate said pin, so as to adjust one end of said yoke in height relative to the other end thereof.

2. A machine as set forth in claim 1, in which
said upper rolls, lower rolls, and adjusting shaft means have generally parallel axes, and
said connecting rods are pivoted to said yoke at points spaced apart in the direction of said axes.

3. A machine as set forth in claim 2, in which said adjusting shaft means comprise an adjusting shaft, on which both said connecting rods are eccentrically mounted.

4. A machine as set forth in claim 3, in which
said yoke is channel-shaped and disposed over said adjusting shaft,
said connecting rods are pivoted to said yoke at opposite ends thereof,
two axially spaced apart eccentric bushings are mounted on said adjusting shaft and non-rotatably connected thereto, and
each of said connecting rods is rotatably mounted on one of said bushings.

5. A machine as set forth in claim 2, in which
said connecting rods are pivoted to said yoke on a first axis, which is generally parallel to said axes of said upper and lower rolls and of said adjusting shaft means, and
additional connecting rod means are pivoted to said yoke on a second axis which is parallel to and horizontally spaced from said first axis and are arranged to control the angular position of said yoke about said first axis.

6. A machine as set forth in claim 5, in which said additional connecting rods are eccentrically mounted on a second shaft and arrange to tilt said yoke about said first axis in response to a rotation of said second shaft.

7. A machine as set forth in claim 2, which comprises
a motor and
a torque-limiting coupling connecting said motor to said adjusting shaft means.

8. A machine as set forth in claim 2, in which
said frame comprises vertical guideways, which face each other and are spaced apart in a direction which is generally at right angles to said axes,
said yoke is disposed between said guideways,
guide rollers are disposed between said yoke and each of said guideways and have flat sides slidably engaging said guideways for vertical movement relative thereto, and
mounted means connect said guide rollers to said yoke so that said yoke is angularly movable relative to said guide rollers and said guide rollers are vertically movable in unison with said yoke.

9. A machine as set forth in claim 8, in which
each of said guide rollers has curved peripheral surface portions at opposite ends of a diameter of said guide roller and
said mounting means comprise axially spaced apart peripheral lubricating grooves formed in said curved peripheral surface portions of each of said guide rollers at said opposite ends of said diameter and retaining means carried by said yoke and engaging each of said guide rollers in said lubricating grooves thereof at diametrically opposite points of said roller.

10. A machine for flattening sheet metal, comprising
a stationary frame,
a stationary set of upper rolls carried by said frame,
a yoke mounted in said frame for adjustment in height,
a set of lower rolls mounted in said yoke adjacent to said upper rolls and adjustable in height relative thereto in unison with said yoke,
adjusting shaft means mounted in said frame for rotation on a horizontal axis,
first motion-transmitting means which are eccentric to said adjusting shaft means and non-rotatably connected thereto, and
second motion-transmitting means connected to said yoke for rotation relative thereto about an axis which is offset from said horizontal axis and engaging said first motion-transmitting means and arranged to adjust said yoke in height in response to a rotation of said first motion-transmitting means.

11. A machine as set forth in claim 10, which comprises means for controlling the angular position of said yoke about said offset axis.

* * * * *